US012595634B2

(12) United States Patent
Dumay et al.

(10) Patent No.: US 12,595,634 B2
(45) Date of Patent: Apr. 7, 2026

(54) FORMWORK DEVICE EQUIPPED WITH A DEVIATION- MEASURING DEVICE

(71) Applicant: Soletanche Freyssinet, Rueil-Malmaison (FR)

(72) Inventors: Jean-Michel Dumay, Rueil-Malmaison (FR); Arnaud Residant, Rueil-Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 18 days.

(21) Appl. No.: 17/918,519

(22) PCT Filed: Apr. 12, 2021

(86) PCT No.: PCT/EP2021/059452

§ 371 (c)(1),
(2) Date: Oct. 12, 2022

(87) PCT Pub. No.: WO2021/209392

PCT Pub. Date: Oct. 21, 2021

(65) Prior Publication Data

US 2023/0175224 A1 Jun. 8, 2023

(30) Foreign Application Priority Data

Apr. 14, 2020 (FR) ..... 2003694

(51) Int. Cl.
*E02D 5/18* (2006.01)
*E02D 9/00* (2006.01)
(Continued)

(52) U.S. Cl.
CPC ..... *E02D 5/185* (2013.01); *E02D 5/182* (2013.01); *E02D 9/00* (2013.01); *E02D 13/06* (2013.01); *E02D 5/68* (2013.01)

(58) Field of Classification Search
CPC ..... E04G 11/34; E02D 5/187; E02D 17/13; E02D 5/185; E02D 5/182; E02D 9/00; E02D 13/06; E02F 3/10; E02F 3/085
See application file for complete search history.

(56) References Cited

U.S. PATENT DOCUMENTS 4,681,483 A * 7/1987 Camilleri ..... E04G 11/34 405/303
4,861,199 A * 8/1989 Hackmack ..... E02F 3/142 405/270

(Continued)

FOREIGN PATENT DOCUMENTS

DE 726809 C 10/1942
DE 3526197 A1 2/1987

(Continued)

OTHER PUBLICATIONS

International Search Report and Written Opinion for PCT/EP2021/059452 mailed Jul. 12, 2021, 13 pages.

*Primary Examiner* — Edwin J Toledo-Duran
(74) *Attorney, Agent, or Firm* — ROTHWELL, FIGG, ERNST & MANBECK, P.C.

(57) ABSTRACT

The invention relates to a formwork device (10) for an end of a panel of a molded wall, said formwork device extending along a longitudinal direction (A) and comprising at least one first formwork element (20) including: a base (22) extending along the longitudinal direction (A) and having an outer face (24); a housing (28) interacting with the base and extending along the longitudinal direction; at least one measuring device (40) making it possible to determine at least one first deviation parameter (d1) representative of the deviation of the base (22) with respect to a first vertical plane (P1); and a signal-transmitting device (50) connected to the (Continued)

measuring device (40) to transmit the first deviation parameter ($\alpha$1, d1, $\beta$) to a reception station (60) located at the surface.

18 Claims, 13 Drawing Sheets

(51) Int. Cl.
*E02D 13/06* (2006.01)
*E02D 5/68* (2006.01)

(56) References Cited

U.S. PATENT DOCUMENTS 4,884,939 A * 12/1989 Nielsen ..... E02F 3/435 901/47
4,930,940 A * 6/1990 Charlier ..... E02D 5/18 405/303
5,056,242 A * 10/1991 Miotti ..... E02F 3/205 37/91
5,056,959 A * 10/1991 Cannac ..... E02D 9/00 405/303
5,113,609 A * 5/1992 Camilleri ..... E02F 5/14 37/352
5,263,798 A * 11/1993 Dupeuble ..... E02F 3/26 405/287
5,311,683 A * 5/1994 Camilleri ..... E02F 3/08 37/355
7,010,873 B2 * 3/2006 Kinoshita ..... E02F 5/06 37/906
8,640,364 B2 * 2/2014 Arzberger ..... E02D 17/13 37/189
9,371,623 B2 * 6/2016 Coupland ..... E02D 17/13
10,988,911 B2 * 4/2021 Coupland ..... E02D 19/18
2005/0091885 A1 * 5/2005 Arzberger ..... E21B 4/003 37/347
2013/0223939 A1 * 8/2013 Schwanz ..... E02F 3/205 405/267
2016/0145825 A1 * 5/2016 Steff De Verninac .... E02F 1/00 405/284
2020/0340201 A1 * 10/2020 Coupland ..... E02D 5/18
2023/0023964 A1 * 1/2023 Spiegl ..... G01N 33/383

FOREIGN PATENT DOCUMENTS

EP 0531600 A1 3/1993
FR 2676763 A1 11/1992
WO 2020002836 A1 1/2020

* cited by examiner

[Fig. 1]
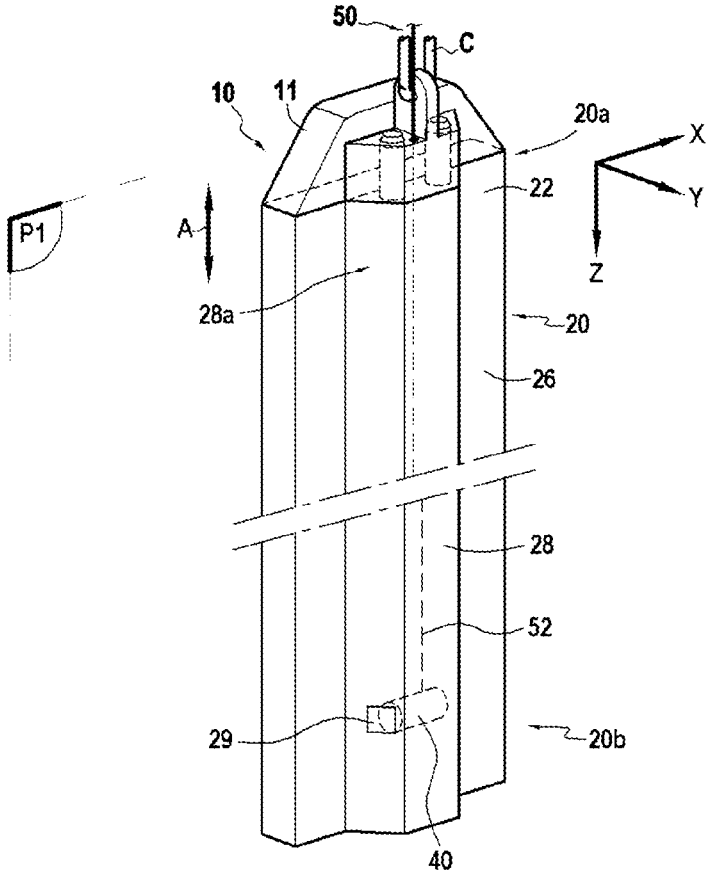
[Fig. 2]
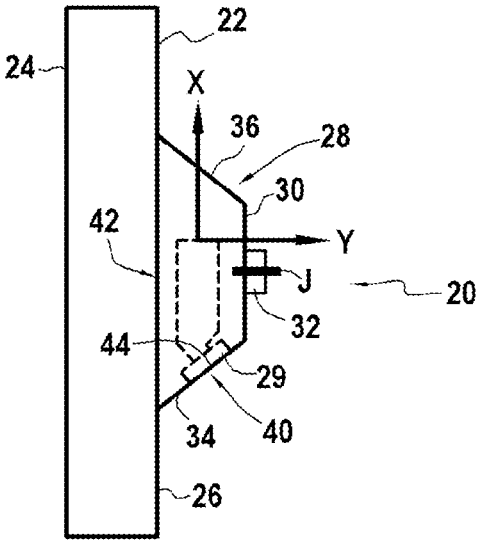

[Fig. 3]
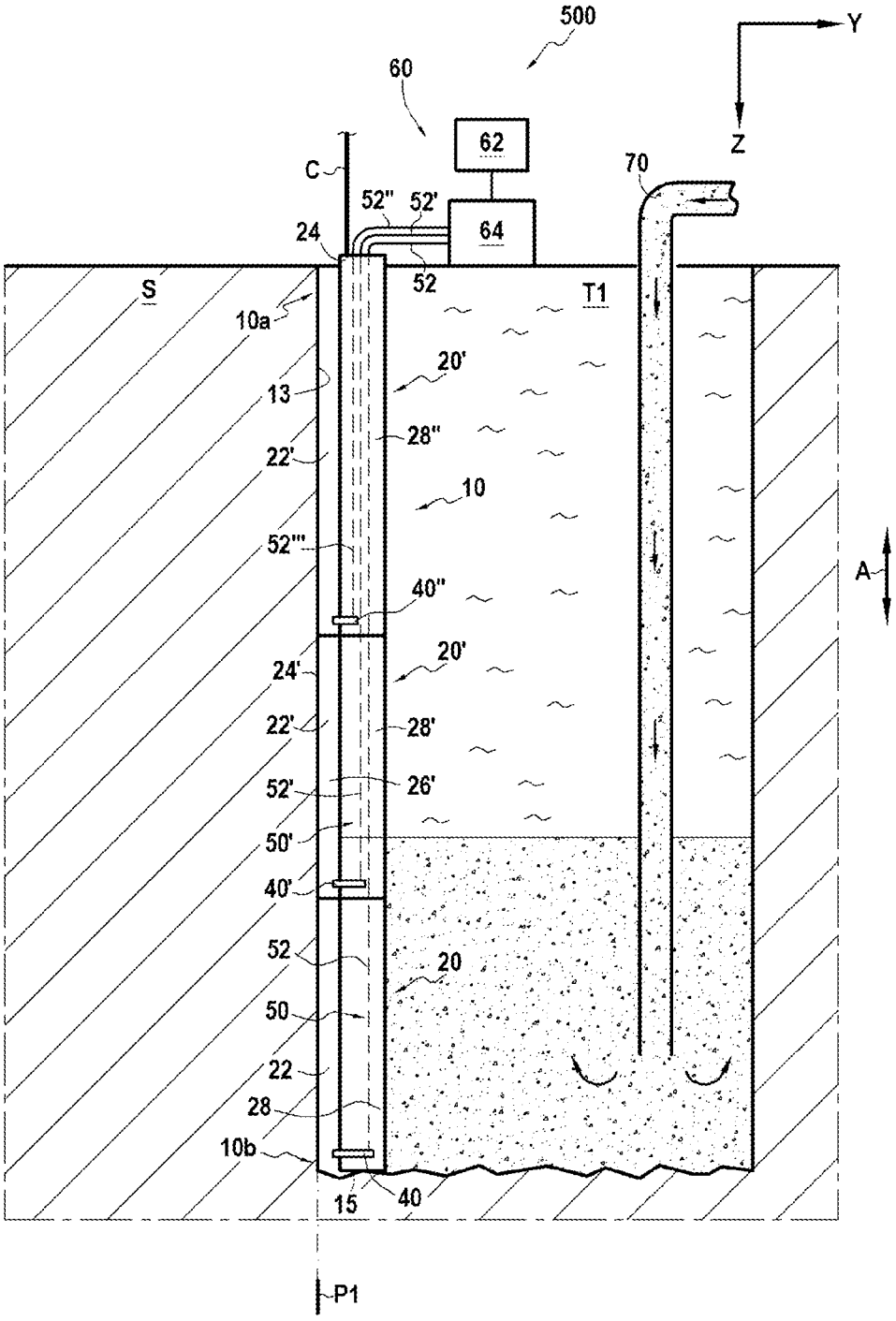

[Fig. 4]
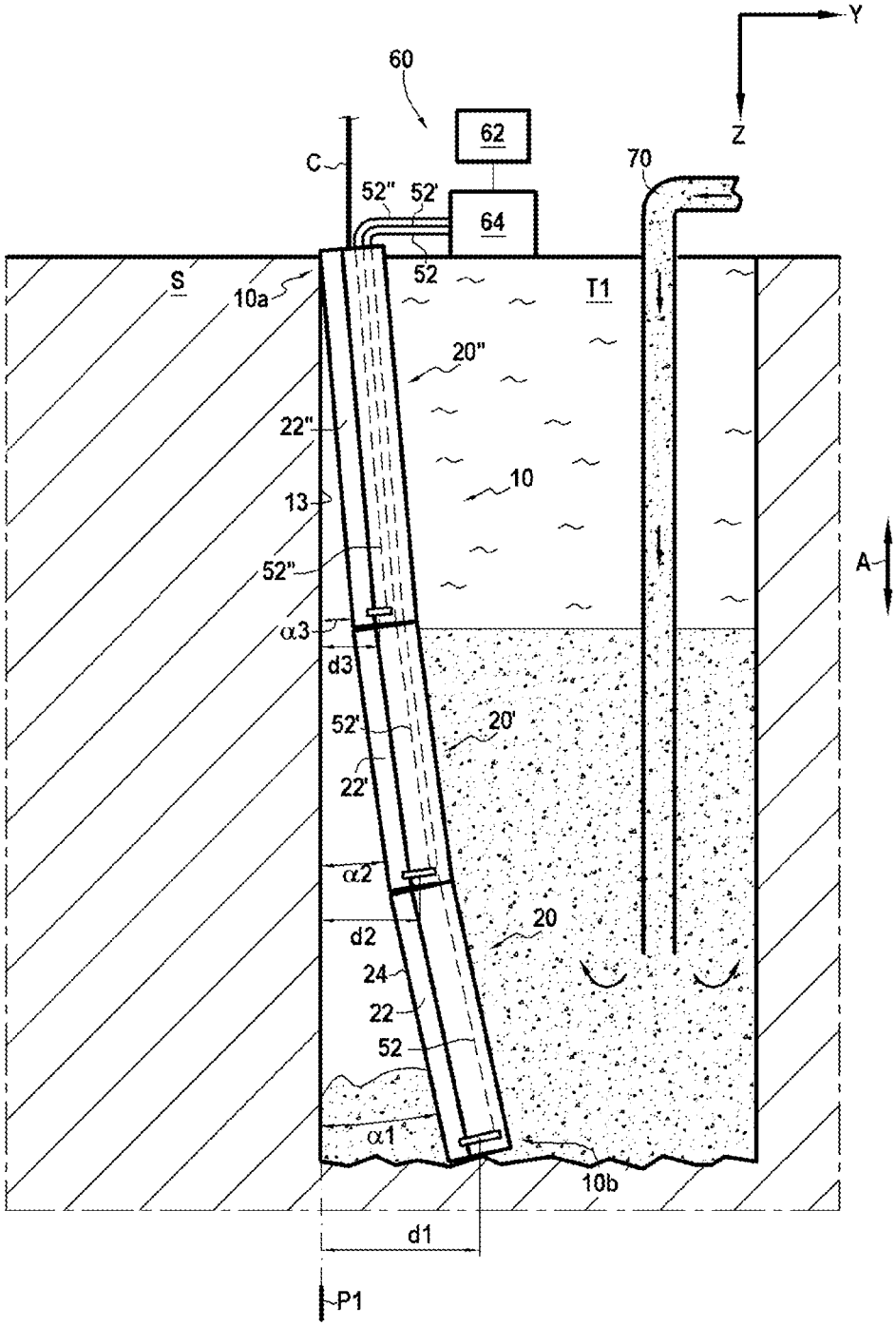

[Fig. 5]
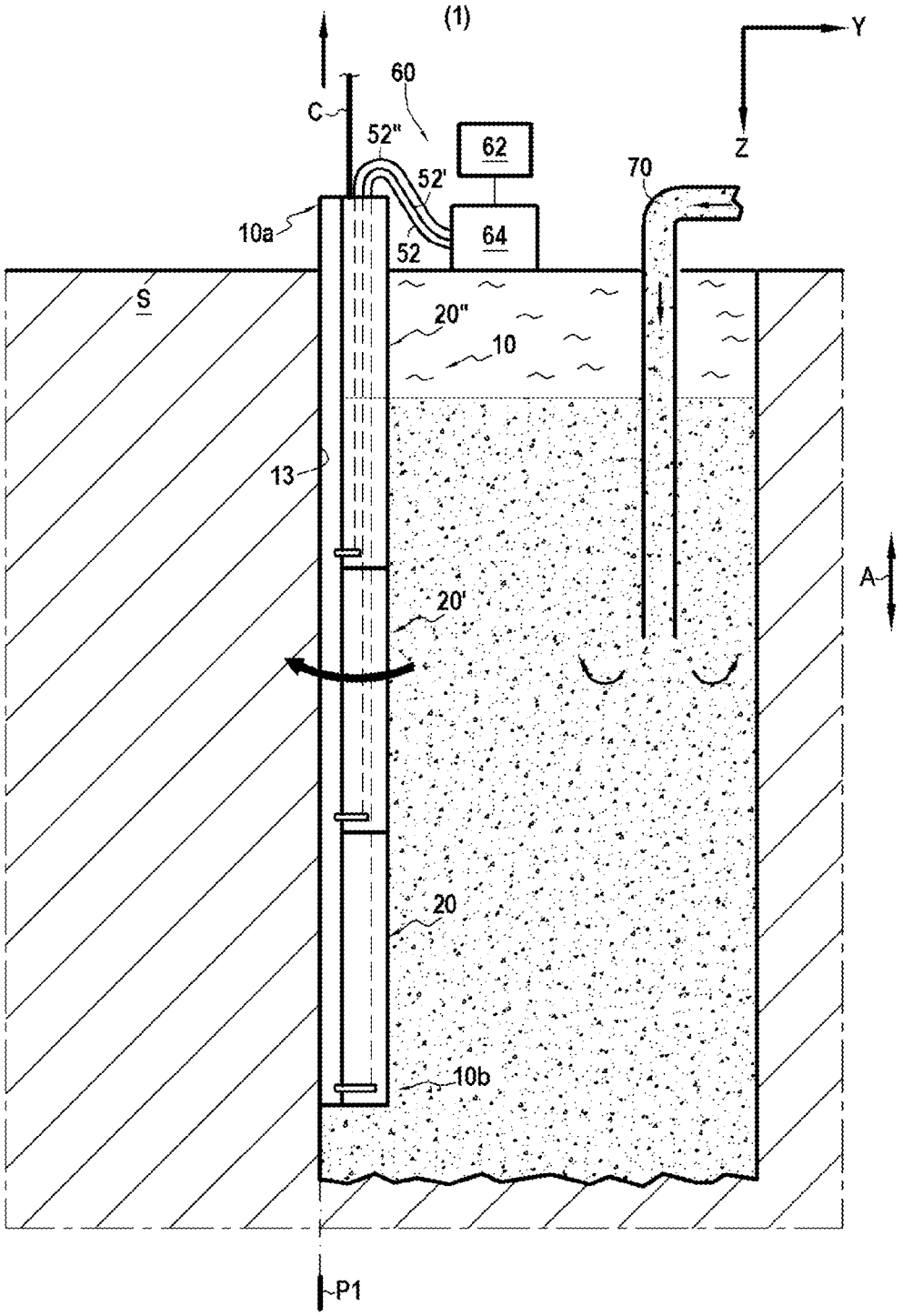

[Fig. 6]
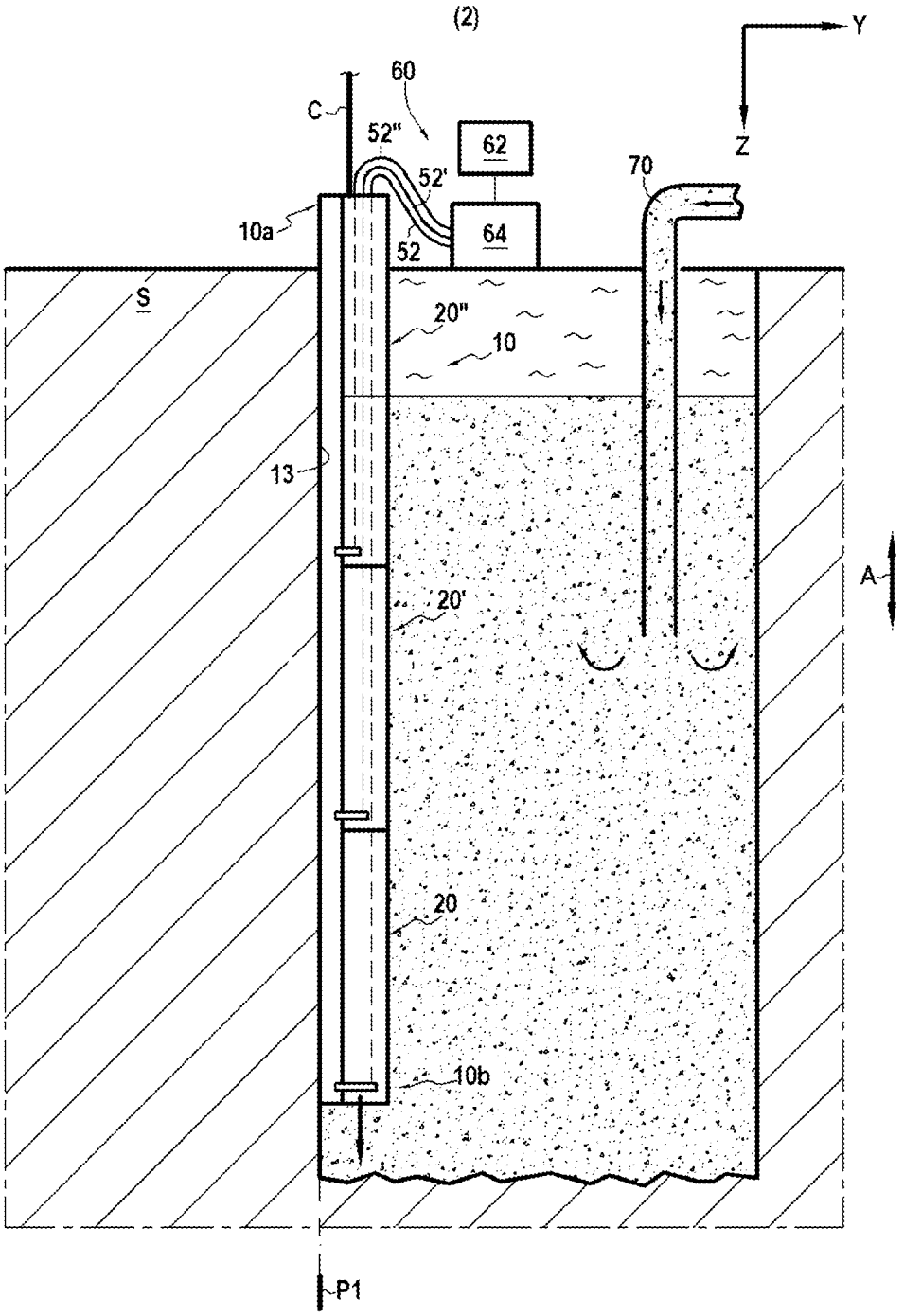

[Fig. 7]
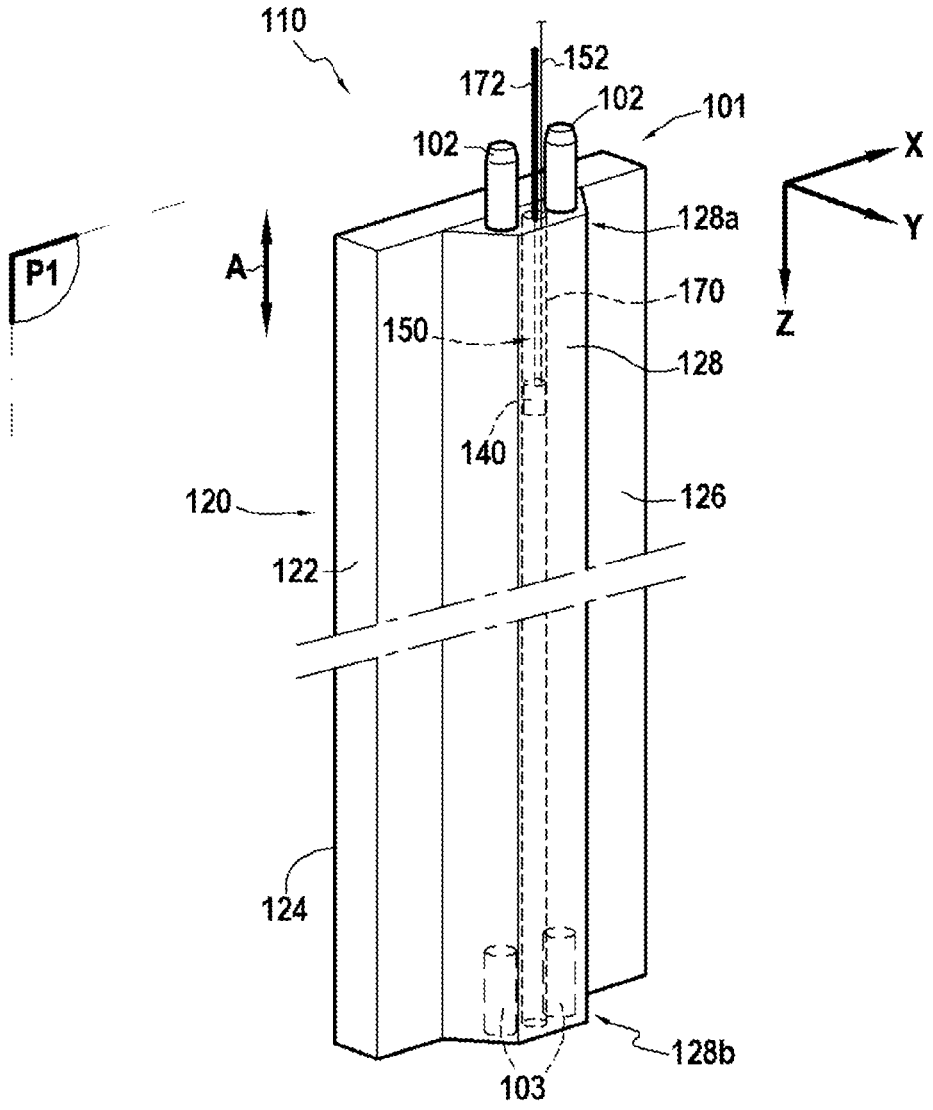

[Fig. 8]
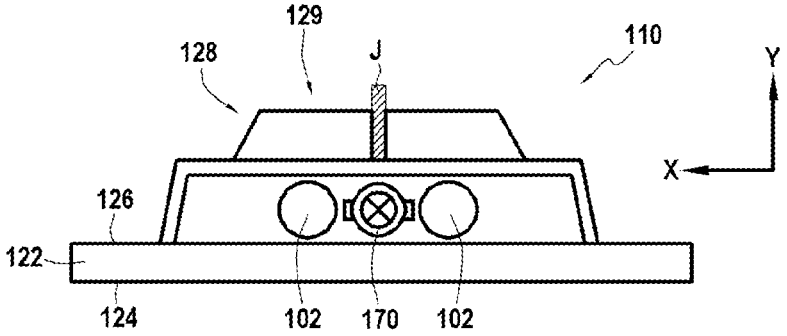
[Fig. 9]
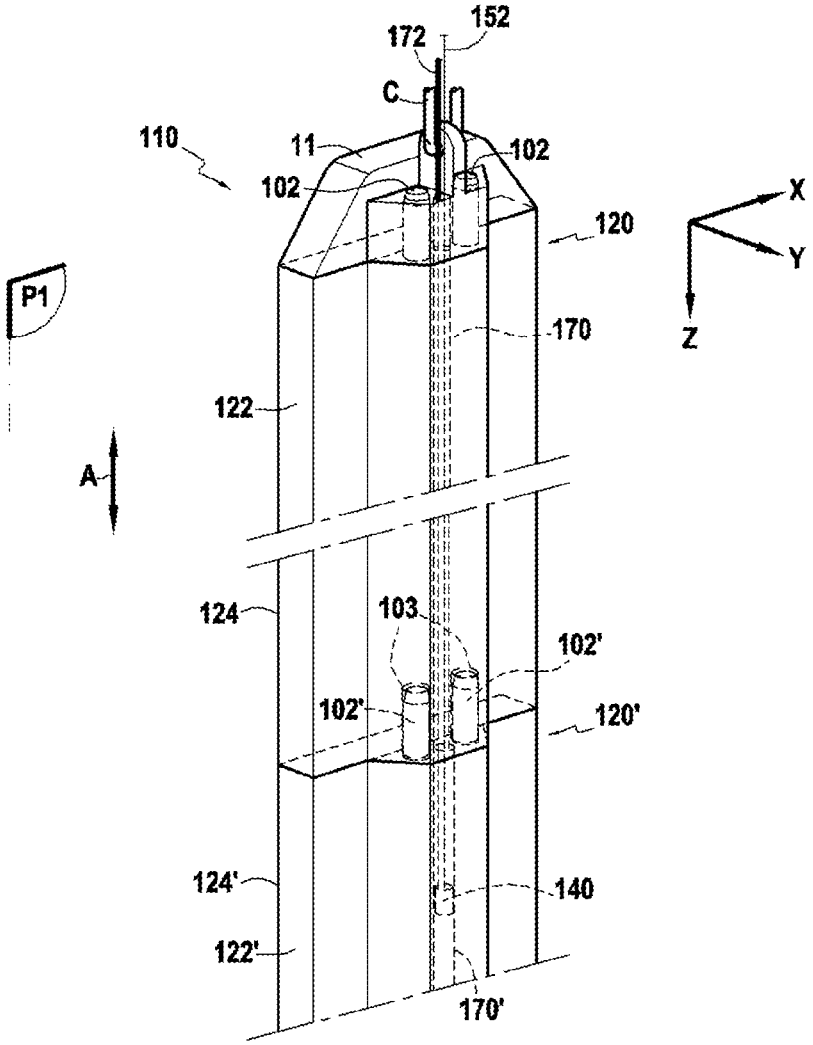

[Fig. 10]
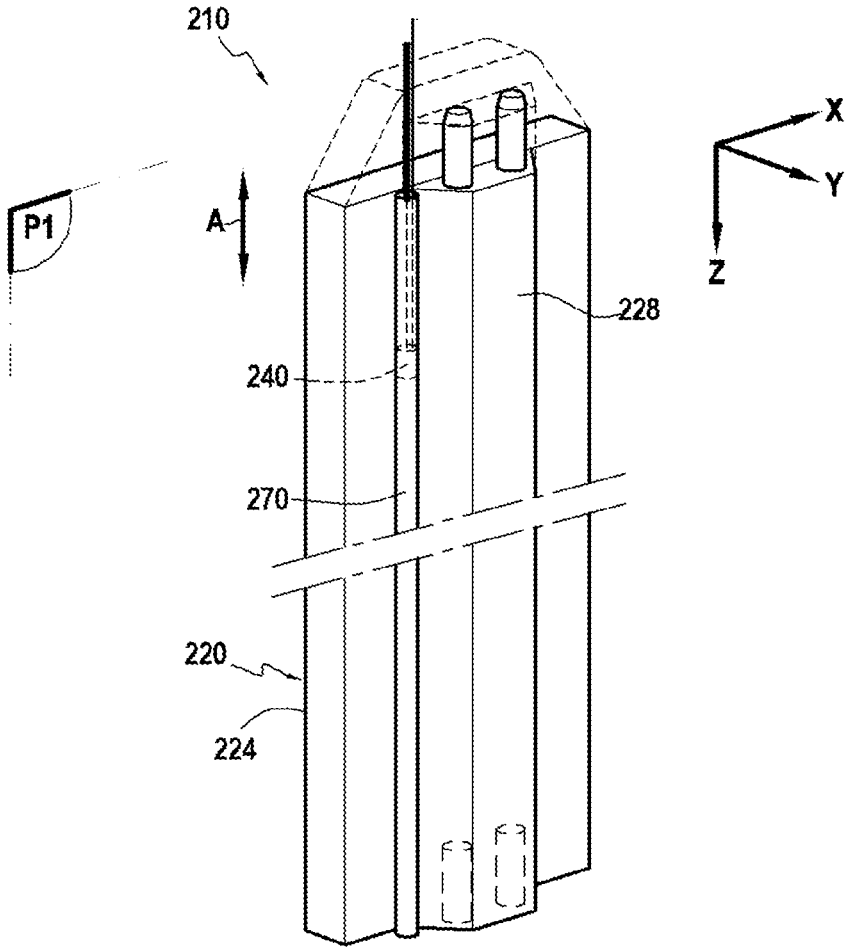
[Fig. 11]
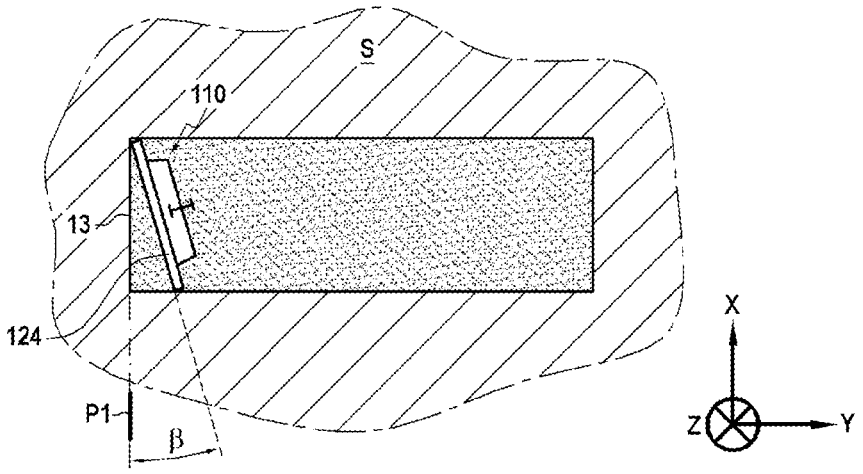

[Fig. 12]
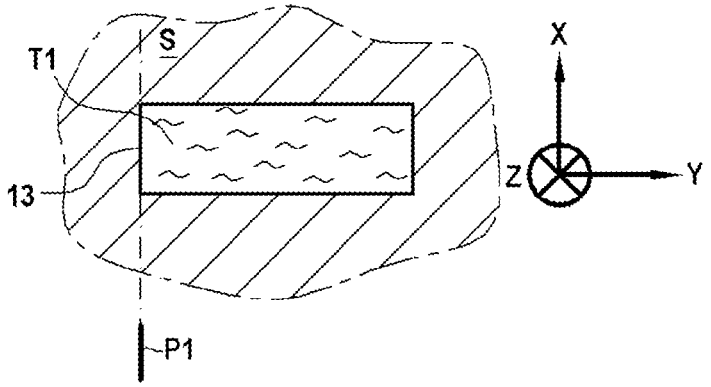
[Fig. 13]
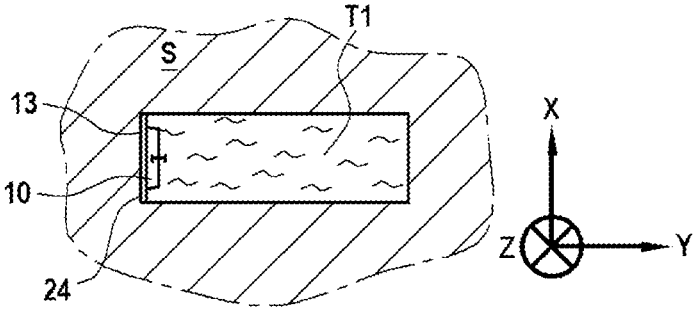
[Fig. 14]
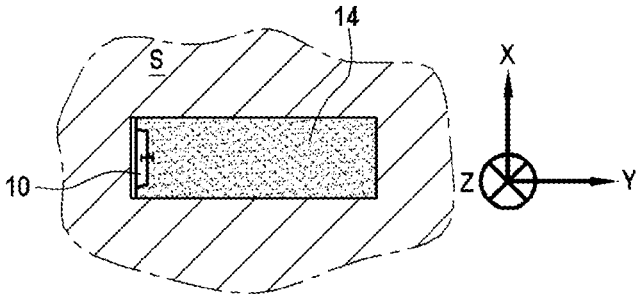

[Fig. 15]
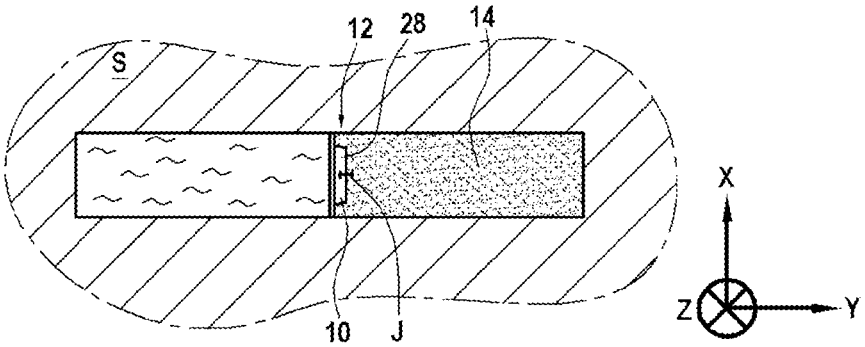
[Fig. 16]
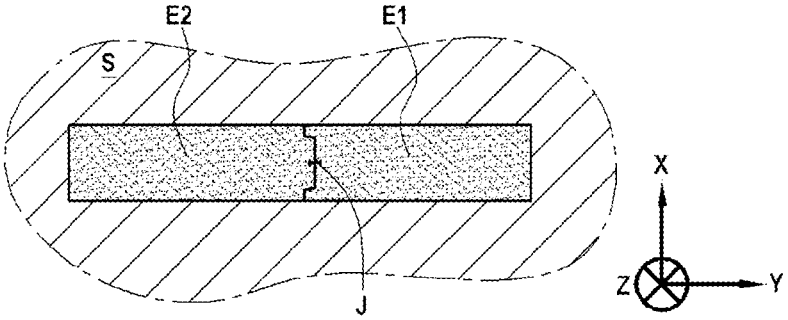

[Fig. 17]
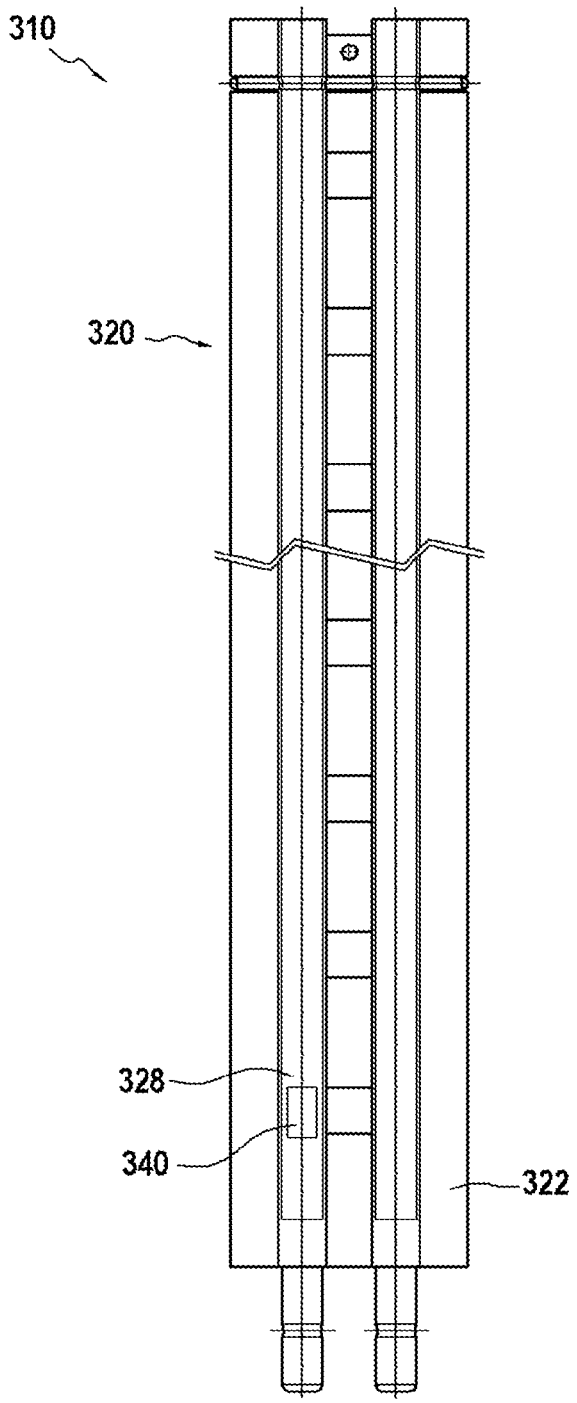

[Fig. 18]
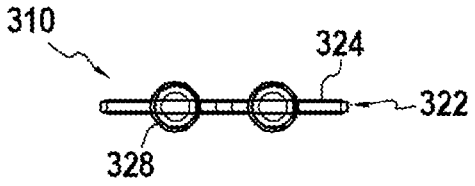
[Fig. 19]
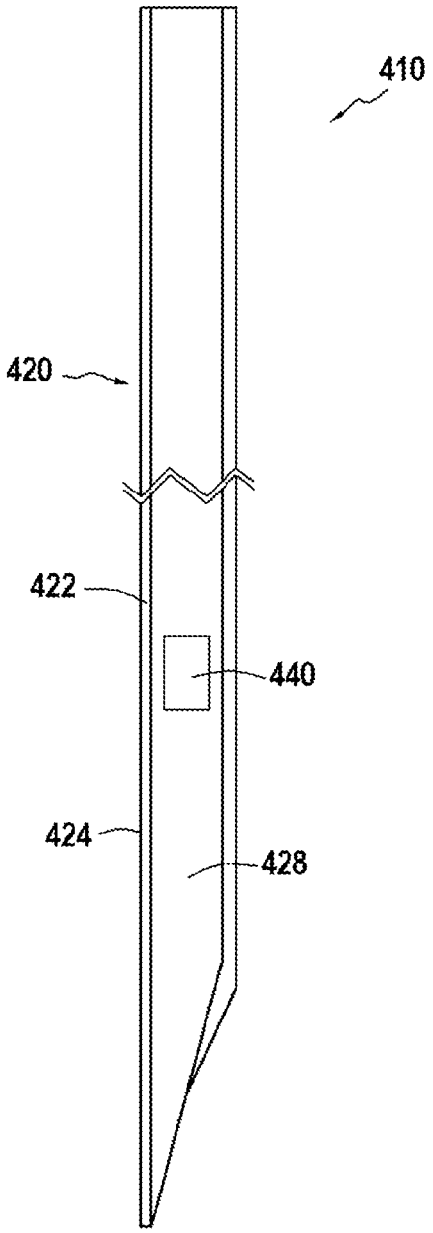

[Fig. 20]
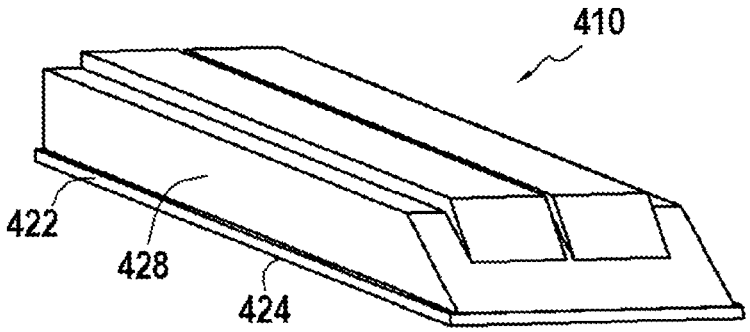

FORMWORK DEVICE EQUIPPED WITH A DEVIATION- MEASURING DEVICE

CROSS REFERENCE TO RELATED APPLICATIONS

This application is a 35 U.S.C. § 371 National Stage of International Patent Application PCT/EP2021/059452, filed Apr. 12, 2021, designating the United States, which claims priority to and the benefit of French Patent Application No. FR2003694, filed Apr. 14, 2020, the entire contents of which are incorporated herein by reference.

TECHNICAL FIELD

This invention relates to the field of building of walls molded into soil. It more precisely relates to formwork techniques relating to the joining of two adjacent wall elements.

BACKGROUND

The joint between two adjacent wall elements, which conventionally take the form of panels, is generally made according to two techniques. According to a first technique, a first trench is excavated in the soil, which is then filled with concrete and, after the setting of the first panel, an adjacent second trench is excavated by overlap with the first panel. The second trench is then filled with concrete.

To improve the seal between the two adjacent panels, another technique is known consisting in placing a vertical seal between the two panels.

After digging a first trench, a temporary formwork element is placed in the first trench, the formwork element including a seal carrier equipped with a vertical seal. According to this technique, the first trench is then filled with concrete to form the first panel and, after the setting of the first panel, a second trench is excavated adjacent to the first trench and the seal carrier is removed from the formwork element, leaving in place the seal which then forms a single part with the first panel while extending into the second trench. This second trench is then filled with concrete to form the second panel. After the setting of the concrete, the seal, in engagement with the first and second panels, makes the seal between these two panels. This process is repeated from neighbor to neighbor until the complete wall is obtained.

The formwork element is generally placed in the trench such as to be disposed against one of the two smallest walls of the trench.

The inventors have found that, in some cases, the formwork element is difficult to remove from the soil since it is sometimes caught in the concrete. This is because, when the formwork element is not correctly positioned against the trench wall, the concrete can circumvent the formwork element during concreting so that, after setting, the formwork element is caught in the cement. Such a phenomenon can also appear if the terrain on which the formwork element bears is rough, causing the debonding of the formwork during concreting.

A removal operation under these conditions is time-consuming and increases the building time of the molded wall.

SUMMARY OF THE INVENTION

One aim of the invention is to provide provision for a formwork device making it possible to dispense with the aforementioned drawbacks.

The invention achieves its aim in that it relates to a formwork device for an end of a panel of a molded wall, said formwork device extending along a longitudinal direction and comprising at least one first formwork element including:

- a base extending along the longitudinal direction and having an outer face,
- a housing interacting with the base and extending along the longitudinal direction;
- at least one measuring device making it possible to determine at least one first deviation parameter representative of the deviation of the base with respect to a first vertical plane; and
- a signal-transmitting device connected to the measuring device to transmit the first deviation parameter to a reception station located at the surface.

The outer face of the base is intended to bear against one of the walls of the trench, and specifically one of the smallest vertical walls of the trench. The outer face is preferably planar. In use, the longitudinal direction is, ideally, substantially vertical.

According to a preferred exemplary embodiment, considered along a plane orthogonal to the longitudinal direction, the housing has a cross section of substantially trapezoidal type. It will be understood that the first formwork element leaves an imprint in the end of the panel of the molded wall which is of complementary shape to that of the housing. Preferably, but not necessarily, the base also has an inner face bearing the coffer.

It will moreover be understood that the formwork device may comprise a single first formwork element according to the invention, attached to other conventional formwork elements devoid of any measuring device. In this case, the first formwork element is preferably, but not necessarily, located at the foot of the formwork device. In other variants, the formwork device includes several formwork elements similar to the first formwork element according to the invention comprising a measuring device.

In accordance with the invention, the measuring device makes it possible to measure a possible deviation of the base with respect to a first vertical plane. This deviation can be an angular value or else a distance measured from the first vertical plane.

The first vertical plane is preferably substantially parallel to the smallest wall against which the first formwork element is placed before the concreting of the trench.

It will be understood that if a deviation of the base with respect to said first vertical plane is identified, this entails that the outer face of the base is locally distant from the wall of the trench against which it should be bearing, which has the effect of forming an interstice in which the concrete is liable to become engaged during the pouring. As explained above, without any other intervention, the formwork element risks being caught between the set concrete of the trench and the set concrete that has become engaged between the outer face and the trench wall.

The invention therefore makes it possible to identify the formation of such an interstice to act, where applicable, on the first formwork element in order to eliminate, or at least substantially reduce, the deviation and therefore the interstice.

The signal-transmitting device has the function of transmitting the data relating to a possible deviation to the reception station. This latter preferably includes a computer and a display screen used to inform the operator of a possible deviation of the first formwork element with respect to the vertical. The operator can then decide to act on the first formwork element in order to correct its orientation, for example by acting on the suspension means generally used for the installation of a formwork element in a vertical trench excavated in the soil.

Advantageously, the measuring device is attached to the coffer. It is preferably disposed at least partly in the housing. This configuration makes it possible to incorporate the measuring device into the first formwork element without impeding the positioning of the outer face of the base against the trench wall. According to an exemplary embodiment, the measuring device is attached in a longitudinal tube which is itself attached in the housing.

According to an embodiment, the housing includes an opening into which the measuring device is inserted. One benefit is that of being able to quickly access the measuring device to facilitate any maintenance operations carried out on the measuring device.

Preferably, the housing includes:

- a central part equipped with a seal carrier and extending along the longitudinal direction, and
- at least one lateral part connecting the central part to the base, the opening being made in the lateral part.

This configuration makes it possible to incorporate the measuring device into the first formwork element such that it does not impede the disengagement of the seal upon the removal of the formwork element from the soil.

According to a preferred embodiment, the measuring device comprises at least one inclinometer. The inclinometer preferably includes a measuring module having substantially the same dimensions as the opening. The measuring module can therefore be easily incorporated into the opening, in particular if it is pre-existing. The inclinometer is preferably, but not necessarily, of biaxial type.

To allow the transmission of the signals to the surface, the signal-transmitting device advantageously includes a cable connected to the measuring device. This cable preferably extends inside the housing. Alternatively, the transmitting device could include a wireless transmission module. Alternatively, the transmitting device could be disposed inside the housing.

Advantageously, the measuring device is disposed at a longitudinal end part of the first formwork element. Preferably, the measuring device is disposed at the lower part of the housing, considered along the longitudinal direction. The cable exits the housing, preferably by its upper end.

According to a preferred embodiment, the formwork device according to the invention further comprises a second formwork element attached to the first formwork element, the second formwork element comprising:

- a base, extending along the longitudinal direction and having an outer face;
- a housing interacting with the base and extending along the longitudinal direction;
- at least one measuring device making it possible to determine a second deviation parameter representative of the deviation of the base of the second formwork element with respect to the first vertical plane; and
- a signal-transmitting device connected to the measuring device of the second formwork element to transmit the second deviation parameter to the reception station.

The first and second formwork elements are attached to one another in the extension of one another. This assembly makes it possible to form formwork devices of great length, required to make panels of great depth. This assembly is preferably done on-site, before the introduction of the formwork device into the trench previously excavated, for example using a hydromill. Still preferably, the base of the second formwork element has an inner face bearing the housing.

Advantageously, the signal-transmitting device of the first formwork element extends inside the housing of the second formwork element. It will be understood that the second formwork element is, in use, disposed above the first formwork element. According to a preferred embodiment, the cable of the measuring device of the first formwork element extends through the housing of the second formwork element, in the same way as the cable connecting to the measuring device of the first formwork element.

Without departing from the scope of this invention, the signal-transmitting devices could also be disposed outside the housings.

The formwork device according to the invention can naturally comprise a number of formwork elements greater than two. In this case, the cable of the measuring device of a lower formwork element extends all the way to the station by extending inside the housings of the upper formwork elements.

According to a second particularly advantageous embodiment, the measuring device is movable with respect to the housing along the longitudinal direction. Preferably, the measuring device is mounted slidably with respect to the housing.

This embodiment makes it possible to place the measuring device at several depths and, as a consequence, take deviation measurements at several depths. The invention hence makes it possible to determine a deviation profile of the formwork device.

When the formwork device includes several formwork elements connected to one another, it is possible to use a single measuring device which is longitudinally displaceable into each of the successive formwork elements. The invention then makes it possible, owing to the plurality of measurements, to accurately characterize a possible deviation of the formwork device with respect to the vertical plane.

Preferably, the measuring device is movable in the housing. Preferably, the measuring device is mounted slidably in the housing.

Advantageously, the first formwork element includes a guiding tube extending along the longitudinal direction, the measuring device being connected to a displacing device to be displaced inside the guiding tube along the longitudinal direction.

Preferably, the guiding tube is disposed in the housing.

Advantageously, the formwork device according to the second embodiment further comprises a second formwork element attached to the first formwork element, the second formwork element comprising:

- a base extending along the longitudinal direction and having an outer face;
- a housing interacting with the base and extending along the longitudinal direction;
- wherein the measuring device is mounted movably with respect to the housing of the second formwork element along the longitudinal direction.

The measuring device is therefore movable in each of the housings of the formwork device.

When it is present, the guiding tube therefore extends inside the housings of the first and second formwork elements.

In this second embodiment, preferably but not necessarily, the base has an inner face which bears the housing. Advantageously, the first parameter measured is an angle of deviation between the longitudinal direction and the first vertical plane, an angle of deviation between a direction perpendicular to the longitudinal direction and the first vertical plane, or else a distance taken between the first vertical plane and the outer face of the base, considered in projection in a horizontal plane.

Preferably, the angle of deviation is determined in a plane perpendicular to the wall of the trench against which the base must bear. As explained above, this is usually one of the two smallest vertical walls of the trench. When the trench is straight, in a plane considered in a horizontal plane, said first vertical plane is parallel to the longitudinal direction of the trench, viewed along the length of the trench. In this case, the angle of deviation is preferably determined in a vertical plane parallel to the length of the trench and perpendicular to the first vertical plane. It will be understood that the first deviation parameter then makes it possible to characterize the deviation of the base along the length of the trench. Knowing the depth of the measuring device, it is also possible to determine the longitudinal displacement of the formwork device with respect to the first vertical plane.

In a variant, the measuring device can determine another deviation value, for example an angle of deviation considered between the base and a second vertical plane orthogonal to the first vertical plane. It will be understood that the other deviation value then makes it possible to characterize a possible deviation of the base according to the width of the trench. The second deviation parameter can also be displayed on a screen of the reception station.

As mentioned above, the first deviation parameter can be a distance considered in a horizontal plane between the first vertical plane and the outer face of the base. This distance is preferably measured at the depth at which the measuring device is located.

The second deviation parameter can also be an angle of deviation, considered between the first vertical plane and the outer face of the base, or else a distance considered, in a horizontal plane, between the first vertical plane and the measuring device of the second formwork element.

The invention moreover relates to a formwork installation including a formwork device according to the invention and a reception station connected to the measuring device via the signal-transmitting device of the first formwork element. The formwork device according to the invention comprises, as defined above, at least one first formwork element.

The reception station is preferably located at the surface.

Advantageously, the reception station includes a screen to display at least the value of the first deviation parameter, thanks to which the operator can monitor in real time a possible deviation of the base of the first formwork element.

In the embodiments in which the measuring device is movable, the installation further includes means for translationally displacing the measuring device with respect to the housing.

These means preferably include a motor-driven line, the end of which is attached to the measuring device.

The invention further relates to a concreting method wherein:

- at least one formwork device according to the invention is introduced into a trench,
- concrete is put in the trench and, during the placing of the concrete in the trench:
  - at least one first deviation parameter of the base of the first formwork element with respect to the vertical plane is determined;
  - the formwork device is raised again if the first deviation parameter is greater than a first given threshold and the raising is stopped when the first deviation parameter is less than a second given threshold.

The first deviation parameter is an angle of deviation or else a distance. In this case, the first and second given thresholds are angular values or else distances.

The formwork device is preferably suspended from a suspension cable.

It will then be understood that upon the raising of the formwork device, the latter returns to a vertical position such that the raising has the effect of bringing the base against the wall of the trench and, as a consequence, eliminating the interstice between the base and the wall.

Advantageously, the first formwork device is lowered again after the raising is stopped.

The concreting method according to the invention therefore makes it possible to control the position, and in particular the verticality of the base in the trench, during the concreting operation. In the event of a deviation being identified using the measuring device, the position of the formwork device is therefore modified so as to reduce the deviation. This has the effect of avoiding the formation of an interstice, or at least significantly reducing it, so as to avoid the concrete surrounding and blocking the formwork device in the trench. In other words, owing to the method according to the invention, time-consuming formwork device removal operations resulting from the blocking of the formwork device in the trench during concreting are avoided.

BRIEF DESCRIPTION OF THE DRAWINGS

The invention will be better understood on reading the following description of embodiments of the invention given by way of non-limiting example, with reference to the appended drawings, wherein:

FIG. 1 illustrates a first embodiment of a formwork device according to the invention, comprising a deviation-measuring device equipped with an inclinometer disposed in the housing;

FIG. 2 is a top view of the formwork device of FIG. 1;

FIG. 3 illustrates a step of implementation of a concreting method according to the invention using the formwork device of FIG. 1;

FIG. 4 illustrates the concreting method of FIG. 3, wherein the formwork device has deviated and has become deformed;

FIG. 5 illustrates the preceding concreting method, wherein the formwork device is raised to correct the deviation;

FIG. 6 illustrates the preceding concreting method, wherein the formwork device is lowered again after correcting the deviation;

FIG. 7 illustrates a second embodiment of the formwork device according to the invention, equipped with a movable deviation-measuring device;

FIG. 8 is a top view of the formwork device of FIG. 7;

FIG. 9 illustrates a variant of the second embodiment, the formwork device comprising two formwork elements;

FIG. 10 is a front view of a third embodiment of the formwork device according to the invention;

FIG. 11 is a top view of the trench illustrating an example of a deviation of the formwork device resulting from a rotation about the Z-axis;

FIG. 12 illustrates, in top view, the step of fluid-assisted boring of a trench in the soil;

FIG. 13 illustrates the placing of a formwork device according to the invention at one of the ends of the trench;

FIG. 14 illustrates the concreting of the trench of FIG. 13;

FIG. 15 illustrates the fluid-assisted boring of a second trench adjacent to the first trench;

FIG. 16 illustrates, after the concreting of the second trench and the removal of the formwork device, the juxtaposition of the first and second concrete wall elements;

FIG. 17 is a front view of a fourth embodiment of the formwork device according to the invention;

FIG. 18 is a top view of the formwork device of FIG. 17;

FIG. 19 is a front view of a fifth embodiment of the formwork device according to the invention; and FIG. 20 is a perspective view of the formwork device of FIG. 19.

DETAILED DESCRIPTION

FIG. 1 illustrates a first embodiment of a formwork device 10 for an end 12 of a panel 14 of a molded wall.

The formwork device 10 is part of a formwork installation 500 in accordance with this invention, visible in FIG. 3, further including a reception station 60, located at the surface, which will be described below.

FIGS. 12 to 16 illustrate an exemplary embodiment of a known method for making a molded wall composed of two juxtaposed panels, using a formwork device 10.

The formwork device 10 extends along a longitudinal direction A which, in this example, extends along the vertical direction Z.

As illustrated in FIG. 1, the formwork device 10 comprises a first formwork element 20 including a base 22 extending along the longitudinal direction A. In this embodiment, the base 22 has an outer face 24 as well as an inner face 26 bearing a housing 28. The housing 28 also extends along the longitudinal direction A. Moreover, in a known manner, the housing includes a seal carrier (not illustrated here) to receive a seal J. As illustrated in FIG. 14, and in a known manner, the seal J has the function of forming the seal at the interface between the first and second molded wall panels E1, E2.

As can be seen in FIG. 2, the first formwork element 20 includes a cross section of substantially trapezoidal shape. The housing 28 meanwhile includes a central part 30 equipped with a seal carrier 32, the central part extending along the longitudinal direction A. The seal carrier is configured to receive a seal J, also known.

The housing 28 further includes a first lateral part 34 connecting the central part 30 to the base 22, and a second lateral part 36, opposite the first lateral part 34, also connecting the central part 30 to the base 22.

In accordance with the invention, the first formwork element 20 further includes a measuring device 40 making it possible to determine at least one first deviation parameter representative of a possible deviation of the base 22 with respect to a first vertical plane P1. In this example, the first vertical plane P1 is coplanar with the vertical wall 13 of the trench T1.

In this example, the measuring device 40 is attached to the housing 28. To do this, the housing 28 includes an opening 29 into which the measuring device is inserted. As will be understood using FIG. 2, in this example, the opening 29 is made in the first lateral part 34 of the housing 28.

In this example, the measuring device 40 comprises an inclinometer 42, for example of biaxial type, including a measuring module 44 having substantially the same dimensions as the opening 29.

The first formwork element 20 further includes a signal-transmitting device 50 which is connected to the measuring device 40 to allow the transmission of the first deviation parameter to the reception station 60 located at the surface.

Such a reception station 60 is illustrated in FIGS. 3 to 6.

In this example, the signal-transmitting device 50 includes a cable 52 which is connected to the measuring device 40 on the one hand, and to the reception station 60 on the other hand.

Still in this example, it can be seen that the cable 52 extends inside the housing 28.

Moreover, the measuring device 40 is, in this example, disposed at a longitudinal end part 20*b* of the first formwork element 20. Here this is the lower end part of the first formwork element. Without departing from the scope of this invention, the measuring device 40 could be disposed in the middle of the length of the first formwork element 20.

As can be seen in FIG. 2, the measuring device 40 is incorporated into the housing, the measuring module 44 extending substantially in the same plane as the first lateral part 34. Owing to this arrangement, the presence of the measuring device 40 does not impede the driving of the formwork device into the soil.

Moreover, the cable 52 exits the housing by its upper longitudinal end 28*a*, as illustrated in FIG. 1.

Without departing from the scope of this invention, and as will be seen below, the formwork device 10 preferably comprises several formwork elements attached to one another by their longitudinal ends.

In a known manner, the formwork elements are attached to one another on the site before the insertion of the formwork device into the soil. This makes it possible to obtain a formwork device of great length composed of a plurality of unitary forming elements. It will therefore be understood that the formwork elements are brought individually to the site, which facilitates their handling.

FIG. 3 illustrates, along a section view taken in a vertical plane, the trench T1 during concreting.

As explained above, prior to the concreting, the formwork device 10 according to the invention has been introduced vertically into the trench T1 such that the base 22, and more precisely its outer face 24 comes to bear against the small vertical wall 13 of the trench T1, which is also illustrated in FIG. 11.

In this example, the formwork device 10 includes three formwork elements attached successively to one another, namely the first formwork element 20 previously described, a second formwork element 20' and a third formwork element 20", the first, second and third formwork elements 20, 20', 20" being attached to one another by their ends such as to form the formwork device 10.

It will therefore be understood that the second formwork element 20' is attached to the first formwork element 20. Like the first formwork element, the second formwork element 20' comprises a base 22' extending along the longitudinal direction A and having an outer face 24' as well as an inner face 26' carrying a housing 28' also extending along the longitudinal direction A.

The second formwork element 20' further includes a measuring device 40' making it possible to determine a second deviation parameter representative of the deviation of the base 22' of the second formwork element 20' with respect to the first vertical plane P1. The second formwork element further comprises a signal-transmitting device 50', comprising in this example a cable 52', connected to the measuring device 40' of the second formwork element 20' to transmit the second deviation parameter to the reception station 60. As can be seen on FIG. 3, the signal-transmitting device 50 of the first formwork element 20, and in particular the cable 52, extends inside the housing 28' of the second formwork element 20'. In a variant, provision could be made for a single BUS-type cable composed of several cable portions—with one cable portion per formwork element—connected to one another by way of connectors disposed between the formwork elements.

To do this, the common longitudinal end of the housings 28 and 28' has openings to allow the cable 52 to become engaged in the housing 28'.

As previously explained, the formwork device 10 further includes a third formwork element 20", similar to the first and second formwork elements 20, 20'. The third formwork element 20" also includes a measuring device 40" making it possible to determine a second deviation parameter representative of the deviation of the base 22" of the second formwork element 20' with respect to the first vertical plane P1.

It also includes a transmitting device 50" connected to the measuring device 40" of the third formwork element 20" to transmit the third deviation parameter to the reception station 60.

It can be seen in FIG. 3 that the signal-transmitting devices 50, 50' of the first and second formwork elements 20, 20' traverse the housing 28" of the third formwork element 20".

The cables 52, 52' and 52" of the first, second and third formwork elements 20, 20', 20" are therefore connected to the reception station 60 disposed at the surface.

The latter includes a screen 62 allowing the operator to view the first, second and third deviation parameters measured by the measuring devices 40, 40' and 40". The reception station 60 further includes a computer 64 to receive the data transmitted by the transmitting devices.

More precisely, the cables 52, 52' and 52" of the first, second and third formwork elements are connected to the computer 64 of the reception station 60.

The reception station 60 is connected to the measuring devices 40, 40', 40" via the transmitting devices 50, 50', 50" of the first, second and third formwork elements 20, 20', 20".

As described above, the reception station 60 includes a screen 62 to display the value of the first deviation parameter, and where applicable, the values of the second and third deviation parameters.

The installation 500 further includes a suspension cable C which is preferably attached to the upper longitudinal end 10*a* of the formwork device 10 by way of an added lifting head 11 which is attached to the formwork element. This suspension cable C is connected to a carrier, also known and not shown here, disposed at the surface and making it possible to carry and displace the formwork device 10.

Using FIGS. 3 to 5, there will now follow a description of a concreting method in accordance with the invention.

FIG. 3 illustrates the start of the concreting method. The formwork device has therefore been placed in the trench T1, such that the formwork device 10 is bearing against the wall 13 of the trench T1, the formwork device 10 being positioned substantially vertically, the lower longitudinal end 10*b* of the formwork device 10 bearing on the bottom 15 of the trench T1.

On FIG. 3, the formwork device 10 therefore extends substantially vertically. According to the concreting method, concrete is put in the trench T1 using a duct 70 connected to a concrete reservoir, not illustrated here.

In accordance with the invention, during the placing of the concrete in the trench T1, one determines at least one deviation parameter of the base 22 of the first formwork element 20 with respect to the first vertical plane P1. In the configuration of FIG. 3, no deviation is measured in the vertical plane YZ with respect to the plane P1.

As illustrated in FIG. 3, the bottom 15 of the trench T1 is not completely flat due to the presence of roughness, such that, during the concreting, concrete can flow between the wall 13 of the trench T1 and the outer face 24 of the base 22. It is also possible that concrete circumvents the sides of the base 22 insofar as the greatest faces of the wall are not strictly planar either. This therefore has the effect that the concrete becomes lodged between the wall 13 and the base 22, as illustrated in FIG. 4. This can have the effect of deviating the base 22. In the example of FIG. 4, the deviation consists in a pivoting of the formwork device in the vertical plane YZ.

According to the concreting method according to the invention, if the deviation parameter is greater than a first given threshold, the first formwork device is raised vertically by operating the suspension cable C, as illustrated in FIG. 5, and the raising is stopped when the deviation parameter becomes less than a second given threshold. This second given threshold can be equal to the first given threshold or slightly less than the first threshold. In the illustration of FIG. 5, the formwork device 10 has returned to its substantially vertical position after being slightly raised, such that there is no concrete between the base 22 and the end 13 of the wall. This will facilitate the formwork removal and ensure sufficient continuity between the two adjacent panels. Preferably, as illustrated in FIG. 6, the formwork device 10 is lowered again after correction of its deviation.

According to a first example, the deviation parameter of the base of the first formwork element 20 with respect to the first vertical plane P1 is an angle of deviation $\alpha$1, corresponding to a rotation about the horizontal axis X. This angle is considered in a vertical plane. In this example, the first given threshold is 2°, while the second given threshold is 1°. These values are given by way of example for a depth of 10 meters. Without departing from the scope of this invention, the second given threshold could be equal to the first given threshold.

According to another example, as illustrated in FIG. 11, the deviation parameter of the base of the first formwork element 20 with respect to the first vertical plane P1 is an angle of deviation $\beta$, corresponding to a rotation about the vertical axis Z. Without departing from the scope of this invention, the measuring device can determine a deviation resulting from the combination of a rotation about the vertical axis Z and a rotation about the axis X.

In a variant, the first deviation parameter representative of the deviation of the base 22 with respect to the first vertical plane P1 consists of the displacement value d1 considered along the horizontal direction Y, between the first vertical plane P1 and the measuring device 40. For example, the first given threshold will be 40 cm, while the second given threshold will be 20 cm. Knowing the depth of the measuring device 40, it is possible to determine an angle of deviation $\alpha$1 of the base with respect to the first vertical plane P1.

Similarly, the formwork device 10 illustrated in FIG. 4, possessing two other measuring devices 40', 40" arranged on the second and third formwork elements 20', 20", make it possible to determine a second deviation parameter $\alpha$2 or d2 representative of the deviation of the base 22' with respect to the first vertical plane P1, and a third deviation parameter $\alpha$3 or d3 representative of the deviation of the base 22" with respect to the first vertical plane P1.

Consequently, knowing the depth of the measuring devices 40' and 40", along with the distances d2 and d3, it is also possible to determine several values of angle of deviation.

Note that the outer faces of the bases 22, 22' and 22" are not necessarily coplanar, in particular when the formwork device is of great length. Also, the angles of deviation α1, α2 and α3 are not necessarily equal, as shown in diagram form in FIG. 4. The deviations illustrated in FIG. 4 have been deliberately exaggerated to improve the legibility of the figure.

The angles of deviation α1, α2 and α3, and/or each of the distances d1, d2 and d3 constituting deviation parameters determined by the measuring devices 40, 40' and 40" can be computed by the computer 64 and displayed on the screen 62 of the station 60.

Using the FIGS. 7 to 9, there will now follow a description of a second embodiment of the formwork device 110 according to the invention. The formwork device 110 extends along a longitudinal direction A and comprises a first formwork element 120 which comprises a base 122 extending along the longitudinal direction A and having an outer face 124 as well as an inner face 126 bearing a housing 128 extending along the longitudinal direction A. The housing 128 comprises a seal carrier 129 intended to receive a seal J.

In this exemplary embodiment, the first formwork element 120 includes a coupling device 101 making it possible to connect and position the first formwork element 120 on another formwork element. In this example, the coupling device includes two lugs 102 extending from the upper longitudinal end 128*a* of the housing 128. The coupling device moreover includes two orifices disposed at the lower longitudinal end 128*b* of the housing 128 of the housing 103 and intended to receive, by interaction of shape, the lugs 102 of another formwork element.

The first formwork element 120 further includes a measuring device 140 making it possible to determine a deviation parameter representative of the deviation of the base 122 with respect to the first vertical plane P1.

Like the first embodiment, the first formwork element 120 moreover includes a signal-transmitting device 150, comprising a cable 152 which is connected to the device 140 to transmit the first deviation parameter to a reception station located at the surface.

Unlike the first embodiment, the measuring device 140 of the first formwork element 120 of the formwork device 110 according to the second exemplary embodiment is movable with respect to the housing 128 along the longitudinal direction A. This second embodiment therefore has the advantage of allowing the determination of a possible deviation of the formwork device at different depths. It therefore allows a more accurate measurement than the first embodiment as long as the measuring device can be positioned at one or more desired depths.

To do this, the first formwork element 120 includes a guiding rube 170 extending along the longitudinal direction A, parallel to the housing. The measuring device 140 is connected to a displacing device 172, consisting in this example of a line which can be displaced inside the guiding tube along the longitudinal direction. The line is connected to an actuator disposed at the surface (not illustrated here), controlled by the operator.

In the exemplary embodiment of FIGS. 7 to 9, the guiding tube 170 is disposed in the housing 128. In this example, it will be understood that the guiding tube 170 extends over the whole length of the housing 128.

With reference to FIG. 8, it will be seen that, in this embodiment, the guiding tube 170 is disposed substantially in the center of the housing considered in a plane perpendicular to the outer face 124 of the base 122.

Without departing from the scope of this invention, the guiding tube 170 could be disposed differently inside the housing.

FIG. 9 illustrates a formwork device 110 further including a second formwork element 120' which is disposed below the first formwork element 120. It can be seen that the lugs 102' of the second formwork element 120' are introduced into the orifices 103 of the first formwork element 120.

The second formwork element 120' comprises a base 122' which extends along the longitudinal direction A. It includes an outer face 124' along with an inner face including a housing 128' extending along the longitudinal direction A. The measuring device 140 is movable with respect to the housing 128' of the second formwork element along the longitudinal direction A. In this example, the guiding tube 170 extends through the housings 128, 128' of the first and second formwork elements 120, 120'.

In a variant, the guiding tube 170 may consist of two tube portions, each being disposed in one of the housings of the first and second formwork elements, the guiding tube portions being aligned with one another when the first and second formwork elements are attached to one another, in order to allow the measuring device to pass from one formwork element to another.

FIG. 10 illustrates a third example of a formwork device 210 according to the invention, which is a variant of the second embodiment of the formwork device 110.

The formwork device 210 according to the third embodiment is distinguished from the second embodiment by the fact that the guiding tube 270, in which the measuring device 240 is movable, is disposed outside the housing. To do this, the guiding tube 270 is attached to the outer face 226 and/or to a lateral part of the housing 228.

FIGS. 17 and 18 illustrate a fourth embodiment of the formwork device 310 according to the invention. Like the other embodiments previously described, the formwork device 310 includes a first formwork element 320 including a base 322 having an outer face 324 and a housing 328. More precisely, in this embodiment, the first formwork element 320 includes two tubular and parallel housings, which extend along the longitudinal direction. The base here takes the shape of a plate, the thickness of which is less than the diameter of the housing 328.

A measuring device 340, similar to those previously described, is disposed in the housing 328. It can be fixed or movable with respect to the housing.

FIGS. 19 and 20 illustrate a fifth embodiment of the formwork device 410 according to the invention. Like the other embodiments previously described, the formwork device 410 includes at least one first formwork element 420 including a base 422 having an outer face 424 and a housing 428. More precisely, in this embodiment, the base 422 forms a face of the housing 428, the latter having in this example a beveled edge.

A measuring device 440, similar to those previously described, is disposed in the housing 428. It can be fixed or movable with respect to the housing.

The invention claimed is:

1. A formwork device for an end of a panel of a molded wall, said formwork device extending along a longitudinal direction and comprising at least one first formwork element including:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal;

the formwork device further including:

at least one measuring device attached to the casing and adapted to determine at least one first deviation parameter representative of the deviation of the base with respect to a first vertical plane; and a signal-transmitting device connected to the measuring device to transmit the first deviation parameter to a reception station located at the surface;

the formwork device further comprising:

a second formwork element attached to the first formwork element, the second formwork element comprising:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal;

at least one measuring device making it possible to determine a second deviation parameter representative of the deviation of the base of the second formwork element with respect to the first vertical plane; and a signal-transmitting device connected to the measuring device of the second formwork element to transmit the second deviation parameter to the reception station.

2. The formwork device as claimed in claim 1, wherein the casing of the first formwork element includes an opening into which the measuring device of the first formwork element is inserted.

3. The formwork device as claimed in claim 2, wherein the casing of the first formwork element includes:

a central part equipped with the seal carrier of the first formwork element and extending along the longitudinal direction, and at least one lateral part connecting the central part to the base of the first formwork element, the opening being made in the lateral part.

4. The formwork device as claimed in claim 1, wherein the measuring device of the first formwork element comprises at least one inclinometer.

5. The formwork device as claimed in claim 1, wherein the signal-transmitting device of the first formwork element includes a cable connected to the measuring device.

6. The formwork device as claimed in claim 5, wherein the cable extends inside the casing of the first formwork element.

7. The formwork device as claimed in claim 1, wherein the measuring device of the first formwork element is disposed at a longitudinal end part of the first formwork element.

8. The formwork device as claimed in claim 1, wherein the signal-transmitting device of the first formwork element extends inside the casing of the second formwork element.

9. The formwork device as claimed in claim 1, wherein the first parameter measured is an angle of deviation between the longitudinal direction and the first vertical plane, an angle of deviation between a direction perpendicular to the longitudinal direction and the first vertical plane, or a distance taken between the first vertical plane and the outer face of the base of the first formwork element, considered in a horizontal plane.

10. A formwork device for an end of a panel of a molded wall, said formwork device extending along a longitudinal direction and comprising at least one first formwork element including:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal;

the formwork device further including:

at least one measuring device adapted to determine at least one first deviation parameter representative of the deviation of the base with respect to a first vertical plane, said measuring device being movable with respect to the casing of the first formwork element along the longitudinal direction; and a signal-transmitting device connected to the measuring device to transmit the first deviation parameter to a reception station located at the surface;

the formwork device further comprising:

a second formwork element attached to the first formwork element, the second formwork element comprising:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal, wherein the measuring device is movable with respect to the casing of the second formwork element along the longitudinal direction.

11. The formwork device as claimed in claim 10, wherein the first formwork element includes a guiding tube extending along the longitudinal direction, the measuring device of the first formwork element being connected to a displacing device to be displaced inside the guiding tube along the longitudinal direction.

12. The formwork device as claimed in claim 11, wherein the guiding tube is disposed in the casing of the first formwork element.

13. The formwork device as claimed in claim 10, wherein the guiding tube extends inside the casings of the first and second formwork elements.

14. A formwork installation including:

a formwork device for an end of a panel of a molded wall, said formwork device extending along a longitudinal direction and comprising at least one first formwork element including:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal;

the formwork device further including:

at least one measuring device adapted to determine at least one first deviation parameter representative of the deviation of the base with respect to a first vertical plane; and a signal-transmitting device connected to the measuring device to transmit the first deviation parameter to a reception station located at the surface;

the formwork device further comprising:

a second formwork element attached to the first formwork element, the second formwork element comprising:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal, wherein the reception station is connected to the measuring device via the signal-transmitting device of at least the first formwork element.

15. The formwork installation as claimed in claim 14, wherein the reception station includes a screen to display the value of the first deviation parameter.

16. The formwork installation as claimed in claim 14, wherein the measuring device is movable with respect to the casing of the first formwork element along the longitudinal direction, and wherein said formwork installation further includes a measuring device displacement device for displacing the measuring device with respect to the casing of the first formwork element.

17. A concreting method comprising:

introducing into a trench at least one formwork device for an end of a panel of a molded wall, said formwork device extending along a longitudinal direction and comprising:

at least one first formwork element including:

a base extending along the longitudinal direction, from a lower end to an upper end, and having an outer face which is planar as well as an inner face bearing a casing which extends along the longitudinal direction along the inner face, from a lower end portion of the base to an upper end portion of the base, said casing comprising a seal carrier extending along the longitudinal direction along the casing, the seal carrier carrying a seal;

the formwork device further including:

at least one measuring device attached to the casing and adapted to determine at least one first deviation parameter representative of the deviation of the base with respect to a first vertical plane; and a signal-transmitting device connected to the measuring device to transmit the first deviation parameter to a reception station located at the surface, putting concrete in the trench and, during the placing of the concrete in the trench:

determining at least one first deviation parameter of the base of the first formwork element with respect to the vertical plane; and raising again the formwork device if the first deviation parameter is greater than a first given threshold and stopping the raising when the first deviation parameter is less than a second given threshold.

18. The concreting method as claimed in claim 17, wherein the first formwork device is lowered again after the raising is stopped.

* * * * *